US006861923B2

(12) United States Patent
Kolehmainen et al.

(10) Patent No.: US 6,861,923 B2
(45) Date of Patent: Mar. 1, 2005

(54) POWER DIVIDER/COMBINER WITH A MULTILAYER STRUCTURE

(75) Inventors: Jari Kolehmainen, Oulu (FI); Ilpo Kokkonen, Oulu (FI)

(73) Assignee: Nokia Corporation, Espoo (FI)

( * ) Notice: Subject to any disclaimer, the term of this patent is extended or adjusted under 35 U.S.C. 154(b) by 44 days.

(21) Appl. No.: 10/390,538

(22) Filed: Mar. 18, 2003

(65) Prior Publication Data

US 2003/0227352 A1 Dec. 11, 2003

(30) Foreign Application Priority Data

Mar. 19, 2002 (FI) ..... 20020522

(51) Int. Cl.[7] ..... H01P 3/08; H01P 5/12

(52) U.S. Cl. ..... 333/128; 333/127; 333/117; 333/125; 333/136

(58) Field of Search ..... 333/100, 112, 333/115–118, 124, 125, 127, 128, 136

(56) References Cited

U.S. PATENT DOCUMENTS

| | | | | |
|---|---|---|---|---|
| 5,206,611 A | | 4/1993 | Russell | 333/127 |
| 5,426,404 A | | 6/1995 | Kommrusch et al. | 333/246 |
| 5,467,064 A | | 11/1995 | Gu | 333/128 |
| 5,534,830 A | * | 7/1996 | Ralph | 333/128 |
| 5,650,756 A | | 7/1997 | Hayashi | 333/100 |
| 5,689,217 A | * | 11/1997 | Gu et al. | 333/116 |
| 5,929,729 A | * | 7/1999 | Swarup | 333/246 |
| 6,525,623 B2 | * | 2/2003 | Sridharan et al. | 333/128 |
| 2002/0008599 A1 | | 1/2002 | Sridharan et al. | 333/128 |

OTHER PUBLICATIONS

Patent Abstracts of Japan, JP 05191116 dated Jul. 30, 1993.
Patent Abstracts of Japan, JP 2002100910 dated Apr. 5, 2002.
Nishikawa K. et al.: "Minaturized Wilkinson Power Divider Using Three–Dimensional MMIC Technology" IEEE Microwave and Guided Wave Letters, IEEE Inc., New York, US, vol. 6, No. 10, Oct. 1, 1996, pp. 372–374, XP000625783; ISSN: 1051–8207 *p. 372, left–hand column—right–hand column, paragraph 1; figures 1,4*.
Madihian M et al.: "GaAs monolithic lCs for an X–band PLL–stabilized local source" IEEE Transactions on Microwave Theory and Techniques Jun. 1986, USA, vol. MTT–34, No. 6, pp. 707–713, XP002248691; ISSN: 0018–9480 *p. 710, last paragraph; figure 10B*.

* cited by examiner

*Primary Examiner*—Barbara Summons
(74) *Attorney, Agent, or Firm*—Squire, Sanders & Dempsey, L.L.P.

(57) ABSTRACT

The invention relates to a power management arrangement which comprises, formed as a multilayer structure (100), several insulating layers (130, 132, 134, 136); several conductive layers (124, 126, 128) functioning as reference planes; a first port (101), a second port (102) and a third port (104); a first transmission line (106) from the first port (101) to the second port (102), a second transmission line (108) from the first port (101) to the third port (104); means (110, 112, 114, 122) for connecting the transmission lines (106, 108) to the ports (101, 102, 104); and at least one passive element (116) between the second and the third port (102, 104). In the presented power management arrangement, the first transmission line (106) is in an insulating layer (130, 132, 134, 136) other than the one where the second transmission line (108) is.

26 Claims, 6 Drawing Sheets

POWER DIVIDER/COMBINER WITH A MULTILAYER STRUCTURE

BACKGROUND OF THE INVENTION

1. Field of the Invention

The invention relates to radio frequency technology and particularly to power management arrangements used in radio and microwave frequency ranges.

2. Description of the Related Art

Power dividers/combiners operating in high frequency ranges are used either to divide or combine radio and microwave signals. A power divider typically comprises an input port and two output ports. The power to the input port is distributed to the output ports evenly or in another proportion. In a power combiner, several input signals are combined into one output signal.

A power divider/combiner according to the prior art is represented by what is called a Wilkinson power divider/combiner. In a conventional Wilkinson power divider/combiner, there is a conductive pattern upon an insulating substrate structure, such as a printed board. The conductive pattern comprises transmission lines of a length of $\lambda/4$ between the input port and the output ports. Qualities required of power dividers/combiners include small power losses, sufficient insulation between the transmission lines and sufficient EMC protection.

However, the Wilkinson power dividers/combiners according to the prior art are large in size and take too much space from the surface layer of the printed board in order for them to be integrated into recent devices requiring increasingly small components. It is difficult to reduce the size of the Wilkinson power dividers/combiners without, for example, deteriorating the insulation between transmission lines and increasing power losses too much.

Thus, a need has arisen for such Wilkinson power dividers/combiners operating in high frequency ranges which would take only a little space from the surface layer of the printed board and in which power losses would also be small and the insulation between transmission lines and the electromagnetic protection of the power divider towards the surroundings would be good.

SUMMARY OF THE INVENTION

An object of the invention is thus to implement a power management arrangement in such a way that an arrangement is achieved which has a small size but yet a good insulating capacity and small power losses.

This is achieved with a power management arrangement which comprises, formed as a multilayer structure, several insulating layers; several conductive layers functioning as reference planes; a first port, a second port and a third port; a first transmission line from the first port to the second port; a second transmission line from the first port to the third port; means for connecting the transmission lines to the ports; at least one passive element between the second and third ports. In the power management arrangement according to the invention, the first transmission line is in a layer other than the one where the second transmission line is.

Preferred embodiments of the invention are described in the dependent claims.

The invention is based on the transmission lines of the power management arrangement being in different layers.

A plurality of advantages is achieved with the power management arrangement according to the invention. Good isolation is achieved between the branches of the different transmission lines in the power management arrangement. Owing to the reference plane structures used in the solution according to the invention, also power losses are reduced and the EMC (Electromagnetic Compatibility) protection is improved. Space is also saved significantly in the surface layer of the printed board.

BRIEF DESCRIPTION OF THE DRAWINGS

The invention will now be described in more detail in connection with preferred embodiments, referring to the attached drawings, of which

DETAILED DESCRIPTION OF THE PREFERRED EMBODIMENTS

Figure 1:
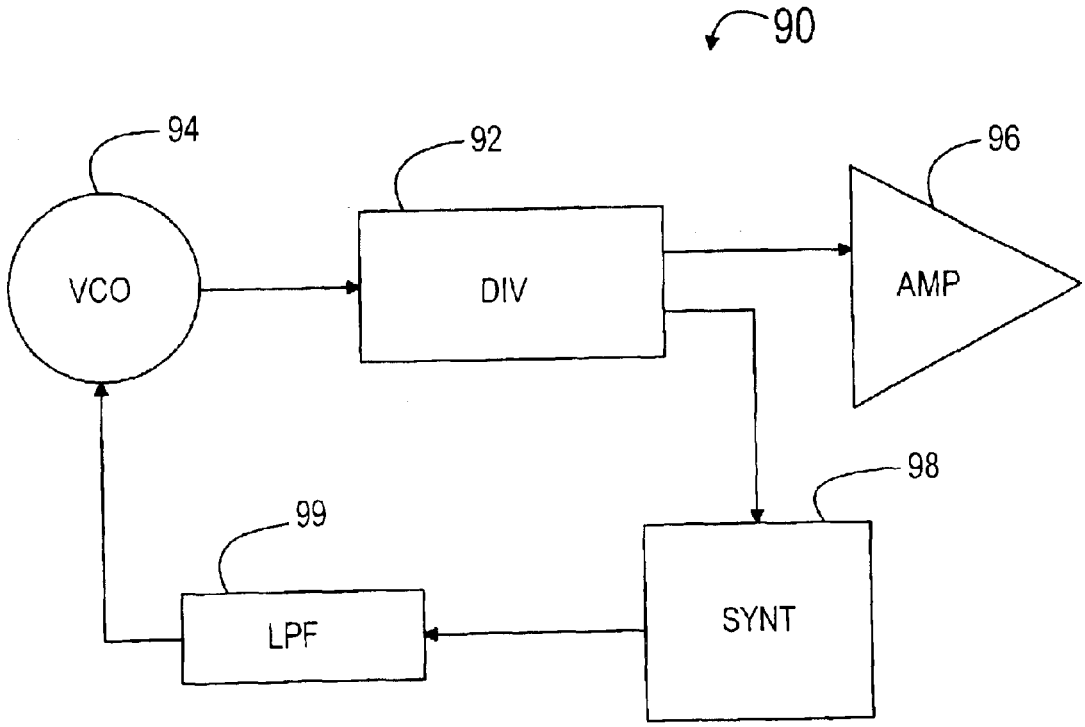
FIG. 1 shows a block diagram of a phase-locked circuit.

FIG. 1 shows a simplified block diagram of a phase-locked circuit 90 which utilizes a Wilkinson power divider implementing the power management arrangement. Phase-locked circuits are widely used in telecommunication systems. The phase-locked circuit is responsible for generating an oscillator signal with sufficient frequency stability and a sufficiently small amount of noise for the receiver and transceiver of a telecommunication system.

In FIG. 1, the phased-locked circuit 90 comprises a voltage-controlled oscillator (VCO) 94, a Wilkinson power divider 92, an output amplifier 96, a synchronizer 98 and a filter 99. The voltage-controlled oscillator 94 generates output power as a response to the input voltage. The Wilkinson power divider 92 is needed for distributing the output power generated by the oscillator to the output amplifier 96 and to the loop comprised by the synchronizer 98 and the filter 99. The filter 99 is usually a low-pass filter, which can be implemented by using amplifiers, resistances and capacitances, for instance.

Figure 2:
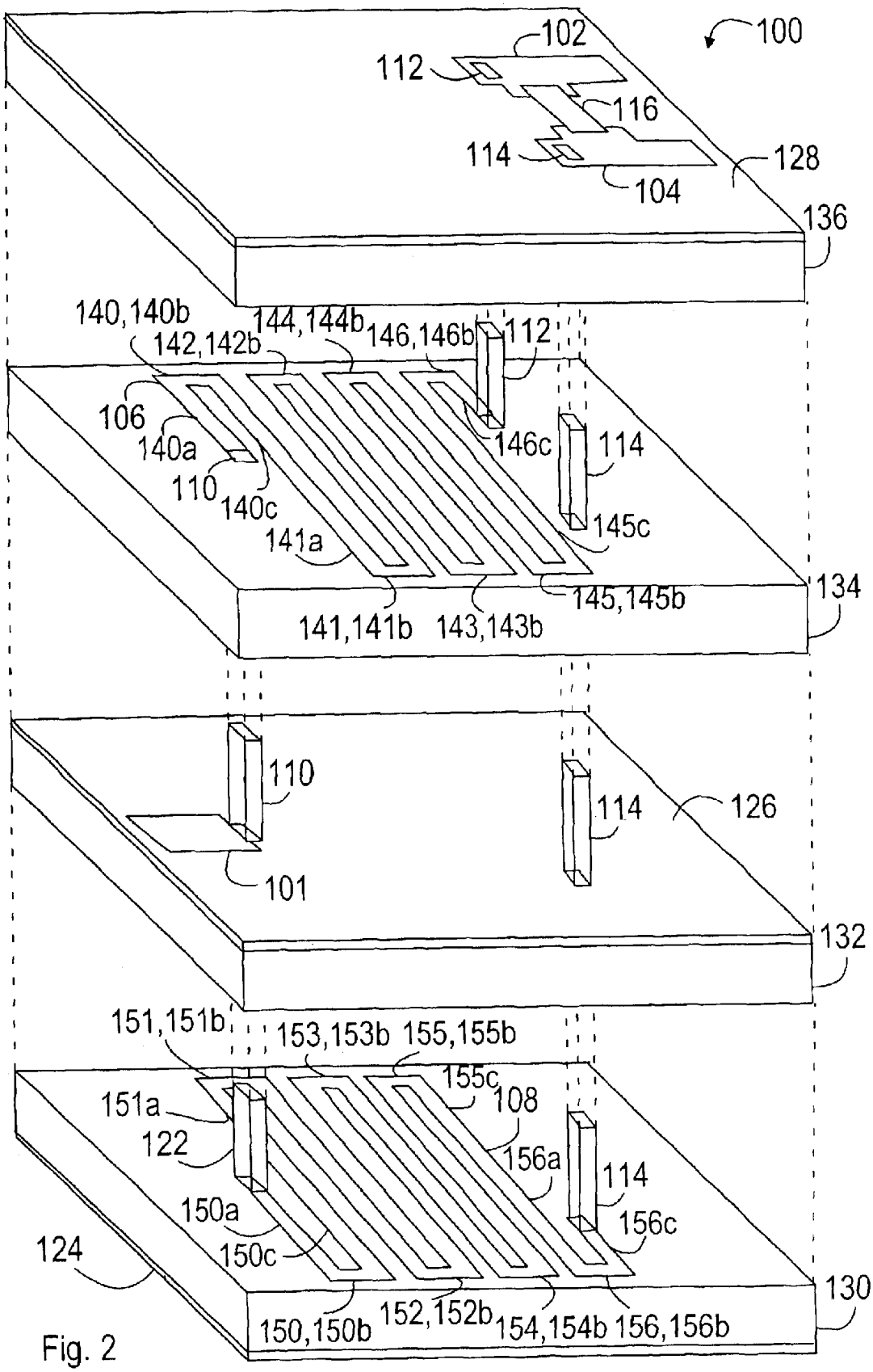
FIG. 2 shows a perspective view of a Wilkinson power divider according to a preferred embodiment of the invention.

FIG. 2 shows a perspective view of a Wilkinson power divider according to the presented solution. The power divider according to FIG. 2 is designed to function at a medium frequency of 1.8 GHz. The Wilkinson power divider according to FIG. 2 comprises, formed as a multilayer structure 100, several insulating layers 130, 132, 134, 136; several conductive layers 124, 126, 128; a first port 101, a second port 102 and a third port 104; a first transmission line 106 and a second transmission line 108; a passive element 116 and several lead-throughs 110, 112, 114, 122 in insulating layers 132, 134, 136 and in conductive layers 126, 128. In FIG. 2, the first transmission line 106 is in the second uppermost insulating layer 134 and the second transmission line 108 is in the lowest insulating layer 130. The middle conductive layer 126 of the conductive layers 124, 126, 128 functioning as reference planes is in the area between the first and the second transmission line 106, 108. In the presented example, the conductive layers 124, 126, 128 functioning as reference planes are, in practice, ground planes.

The insulating layers 130, 132, 134, 136 of the multilayer structure 100 in the example of FIG. 2 are implemented by means of ceramic technologies known as such, for example LTCC (Low Temperature Cofired Ceramic) or HTCC (High Temperature Cofired Ceramic). Alternatively, the insulating layers 130, 132, 134, 136 can be implemented with organic printed board materials according to the prior art. The ceramic material used in implementing the insulating layers 130, 132, 134, 136 is, for instance, a mixture of alumina and glass. In the example of FIG. 2, the thickness of each insulating layer 130, 132, 134, 136 is preferably 0.4 mm, the dielectric constant being 7.7. According to the presented example, the multilayer structure 100 comprises three conductive layers 124, 126, 128 functioning as reference planes. The conductive layers 124, 126, 128 are located in the multilayer structure 100 in such a way that there are two uppermost insulating layers 134, 136 between the middle and the uppermost conductive layer 126, 128 and two lowest insulating layers 130, 132 between the lowest and the middle conductive layer 124, 126, whereby, according to FIG. 2, the areas on the lower and upper surface of the multilayer structure 100 are conductive layers 124, 128, and the layer in the middle of the four insulating layers 130, 132, 134, 136 of the multilayer structure 100 is a conductive layer 126. In the example of FIG. 2, the thickness of each conductive layer 124, 126, 128 is preferably 10 $\mu$m.

Upon the second lowest insulating layer 132 in the multilayer structure 100, there is the first port 101, which functions as an input port. The first port 101 preferably comprises a strip line of 50Ω. The width of the first port 101 is preferably 380 $\mu$m. Upon the uppermost insulating layer 136 in the multilayer structure 100, there are the second port 102 and the third port 104. The second and the third port 102, 104 function as output ports. In the example of FIG. 2, the second and the third port 102, 104 preferably comprise strip lines of 50Ω. The widths of the second and the third port 102, 104 are preferably 460 $\mu$m. Although being implemented with two output ports in the example, the power management arrangement can also be implemented with several output ports. The power management arrangement could also be used for power combining instead of power dividing, in which case the first port 101 would function as an output port and, correspondingly, the second and the third port 102, 104 would function as input ports. In the example, a passive element 116 is mounted between the second and the third port 102, 104, which element is in the example of FIG. 2 preferably a resistor of 100Ω. The purpose of the passive element 116 is to improve the insulation between the second and the third port 102, 104.

Upon the second uppermost insulating layer 134 in the multilayer structure 100, there is the first transmission line 106. The second transmission line 108 is, in turn, upon the lowest insulating layer 130. In the presented solution, the transmission lines 106, 108 are strip lines of a length of $\lambda/4$. The impedances of the first, second and third ports 101, 102, 104 being Zo, the impedance of the transmission lines 106, 108 can, in the example, be calculated by multiplying Zo by square root two. The characteristic impedance of the transmission lines 106, 108 is preferably 70.7 Ω when the impedances of the ports 101, 102 and 104 are 50Ω. The widths of the transmission lines 106, 108 are preferably 80 $\mu$m. The lead-throughs 110, 112, 114, 122 are plated-through, preferably filled with liquid tin, whereby they form the required connections between the ports 101, 102, 104 and the transmission lines 106, 108. The lead-throughs 110, 112, 114, 122 are preferably impedance-matched. The first port 101 is connected to the transmission lines 106, 108 with the lead-throughs 110, 122 formed through the insulating layers 132, 134 and with conductive metal platings formed in the lead-throughs. The first transmission line 106 is by one end 146*c* thereof connected to the second port 102 by means of a conductive metal plating formed in the lead-through 112 leading through the uppermost insulating layer 136. The second transmission line is, in turn, connected by one end 156*c* thereof to the third port 104 with a conductive metal plating formed in the lead-through 114 leading through the insulating layers 132, 134, 136.

In accordance with the example of FIG. 2, both transmission lines 106, 108 are in the form of successive branches 140 to 146, 150 to 156 to save space. In the example of FIG. 2, the successive branches 140 to 146, 150 to 156 comprise diverging areas 140*a* to 146*a*, 150*a* to 156*a* distancing towards the outer edges of the insulating layers 130, 134 and returning areas 140*c* to 146*c*, 150*c* to 156*c* re-approaching the middle area of the insulating layers 130, 134, as well as turning areas 140*b* to 146*b*, 150*b* to 156*b* between the diverging and the returning areas. The turning areas 140*b* to 146*b*, 150*b* to 156*b* preferably form an angle of 90° relative to the diverging and returning areas. The conductive patterns formed by the transmission lines 106, 108 are implemented in manners known as such, preferably with thin-film or thick-film techniques. Alternatively, the conductive patterns formed by the transmission lines 106, 108 can be implemented with growing or etching techniques.

The diverging area 140*a* of the first branch 140 of the transmission line 106 is connected to the first port 101 with a conductive metal plating formed in the lead-through 110, and the diverging area 150*a* of the first branch 150 of the transmission line 108 is connected to the first port 101 with a conductive metal plating formed in the lead-through 122. According to the example, the first diverging areas 140*a*, 150*a* of the transmission lines 106, 108, starting at the first port 101, are on different sides of the first port 101 in such a way that the first diverging areas 140*a*, 150*a* are not physically superposed. The turning areas 140*b* to 146*b*, 150*b* to 156*b* of two successive branches 140 to 146, 150 to 156 are in the example on different sides of the first port 101. The distance between the parallel areas of the branches 140, 142, 144, 146, 151, 153, 155 on the left side of the first port 101 is in the example 200 $\mu$m. The distance between the parallel areas of the branches 141, 143, 145, 150, 152, 154, 156 on the right side of the first port 101 is also 200 $\mu$m. The branches 140 to 146, 150 to 156 of the first and the second transmission line 106, 108 are parallel to each other.

The form of the transmission lines 106, 108, which comprises the branches 140 to 146, 150 to 156, enables significant saving in space in the Wilkinson power divider. When the transmission lines 106, 108 have been positioned in different layers of the multilayer structure 100, a significantly large space becomes free on the uppermost insulating layer 136 of the multilayer structure 100. With the arrangement according to the invention, the Wilkinson power divider takes up to 90% less space on the uppermost insulating layer 136 than it would take if the transmission lines 106, 108 were in the same layer of the multilayer structure 100. In accordance with the presented solution, the transmission lines 106, 108 are located superposed in the multilayer structure 100. In accordance with FIG. 2, the transmission lines 106, 108 are in different layers preferably in such a way that those areas of the branches 140 to 146, 150 to 156 of the first and the second transmission line 106, 108 that are headed towards opposite directions are superposed.

The reference planes functioning as the conductive layers 124, 126, 128 in the example of FIG. 2 form strip line configurations with the transmission lines 106, 108 and the microstrips of the first port 101. A strip line typically comprises a strip line between two reference planes. Thus, the lowest conductive layer 124 and the middle conductive layer 126 function as reference planes for the second transmission line 108. The two lowest insulating layers 130, 132 function as the insulation of the strip line configuration. The lowest conductive layer 124 and the uppermost conductive layer 128 function as reference planes for the first port 101. The middle and the uppermost conductive layer 126, 128 function as reference plane layers for the first transmission line 106.

In the example according to FIG. 2, the middle conductive layer 126, the strip lines of the second and the third port 102, 104 and the insulating layers 134, 136 form microstrip line configurations. Typically, a microstrip line comprises a strip line and a reference plane, between which there is an insulating substrate 130, 132, 134, 136. Thus, the middle conductive layer 126 functions as a reference plane for both the second and the third port 102, 104. Connecting the conductive layers 124, 126, 128, which function as reference plane layers, to the transmission lines 106, 108 and to the ports 101, 102, 104 is implemented with conductive metal platings formed in the lead-throughs 120 in the multilayer structure 100. For the sake of simplicity, the lead-throughs 120 have been omitted from FIG. 2.

Figure 7:
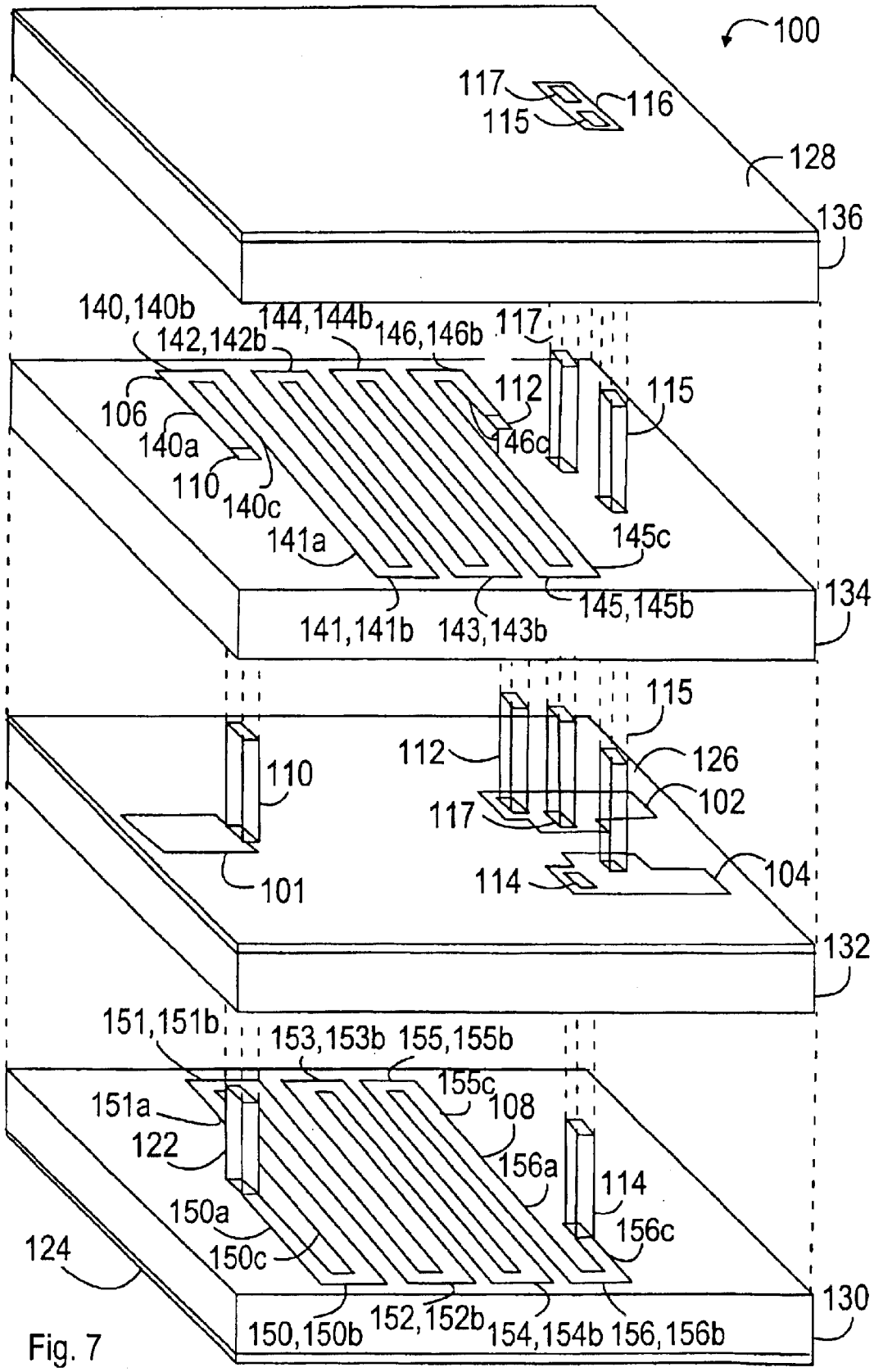
FIG. 7 shows a perspective view of a power divider/combiner according to an embodiment of the invention.

In the presented solution, as shown in FIG. 7, the second and the third port 102, 104 can alternatively be located upon the second lowest insulating layer 132, whereby the lowest conductive layer 124 and the uppermost conductive layer 128 function as reference planes for the ports 102, 104. Thus, the second and the third port 102, 104 form strip line configurations with the conductive layers 124, 128. In this alternative solution, there are lead-throughs 115, 117 from the second and the third port 102, 104 through the two uppermost insulating layers 134, 136 to the passive element 116, such as a resistance.

Figure 3:
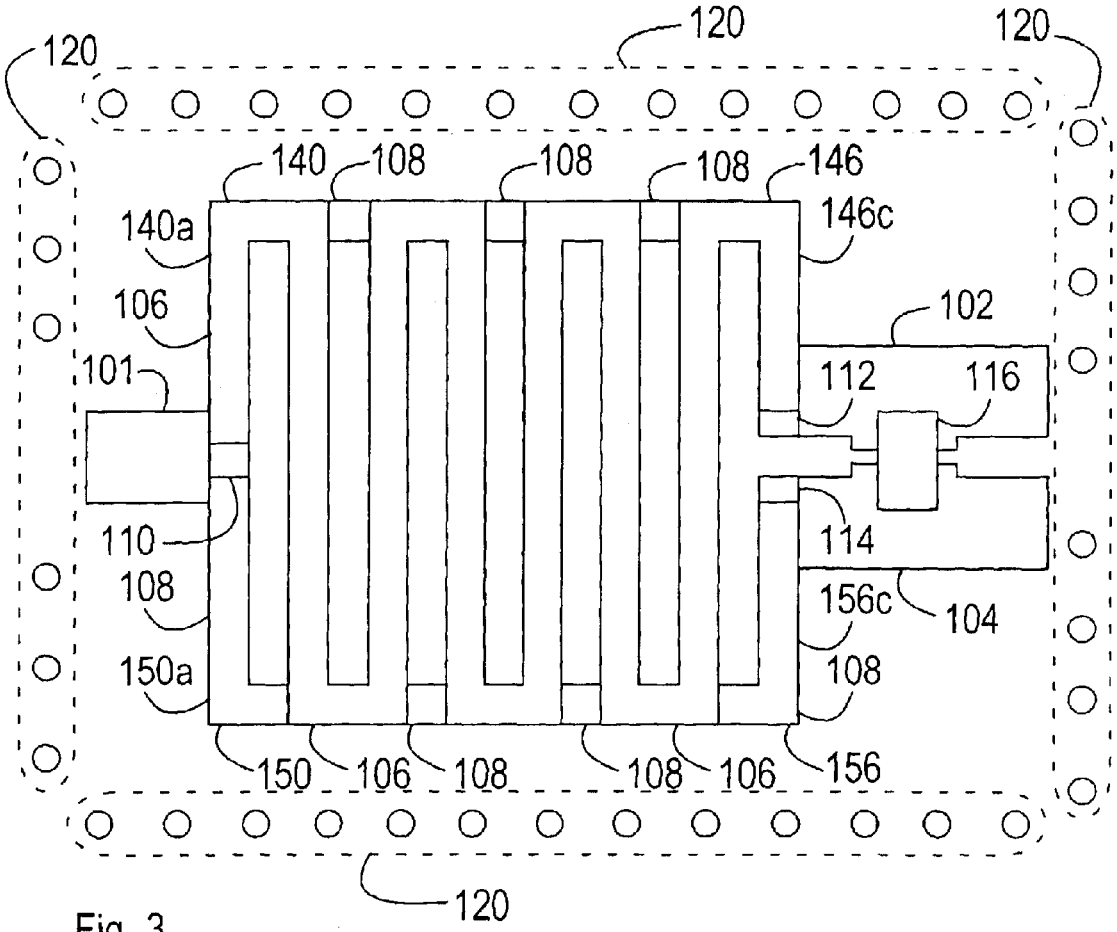
FIG. 3 shows a top view of a detail of a Wilkinson power divider according to a preferred embodiment of the invention.

FIG. 3 shows a top view of a detail of a Wilkinson power divider according to a preferred embodiment of the invention. The example of FIG. 3 is similar to the Wilkinson power divider shown in FIG. 2, but FIG. 3 is simplified in such a way that the conductive layers 124, 126, 128 and the insulating layers 130, 132, 134, 136 have been omitted. FIG. 3 indicates with areas limited by broken lines those lead-throughs 120 that have conductive metal platings by means of which the connection of the conductive layers 124, 126, 128 to the transmission lines 106, 108 and the ports 101, 102, 104 is implemented.

In FIG. 3, the first port 101 is connected to the transmission line 106 upon the second uppermost insulating layer 134 by means of a conductive metal plating formed in the lead-through 110. The transmission line 108 upon the lowest insulating layer 130 is connected to the first port 101 by means of a conductive metal plating formed in the lead-through 122. In FIG. 3, the lead-through 122 is, however, under the lead-through 110 of the first port 101.

As in FIG. 2, the transmission lines 106, 108 comprise successive branches 140 to 146, 150 to 156 also in FIG. 3. The second transmission line 108 is, however, partly under the first transmission line 106 positioned in the upper layer in such a way that it cannot be seen completely from above. In order to easily obtain equal lengths for the transmission lines 106, 108, preferably $\lambda/4$, the first branches 140, 150 of the transmission lines 106, 108, starting at the first port 101, must be on different sides of the first port 101 so that the diverging areas 140*a*, 150*a* of the first branches 140, 150 are not physically superposed. In the example of FIG. 3, the same is true for the other end of the transmission lines 106, 108 as well, whereby the returning areas 146*c*, 156*c* of the last branches 146, 156 of the transmission lines 106, 108 approach the second and the third port 102, 104 from opposite directions. To improve insulation, a passive element 116 is mounted between the second and the third port 102, 104, the element being also in the example of FIG. 3 resistance of 100 Ω.

Figure 4:
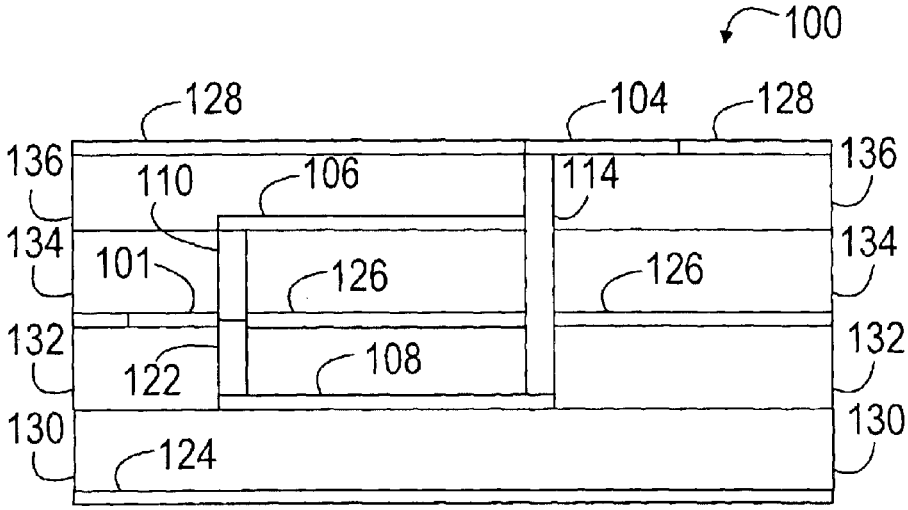
FIG. 4 shows a side view of a detail of a Wilkinson power divider according to a preferred embodiment of the invention.

FIG. 4 shows a side view of a detail of a Wilkinson power divider according to FIGS. 2 and 3. Those lead-throughs 120 that have conductive metal platings by means of which the connection of the conductive layers 124, 126, 128 to the transmission lines 106, 108 and the ports 101, 102, 104 is implemented are not indicated in FIG. 4.

FIG. 4 shows the four insulating layers 130, 132, 134, 136 of the multilayer structure 100; the three layers 124, 126, 128 functioning as reference planes; the first and the third port 101, 104; the first and the second transmission line 106, 108; and lead-throughs 110, 114, 122. The conductive layers 124, 126, 128 seen in FIG. 4 are below and above the insulating layers 130, 132, 134, 136 and between them. Upon the second lowest insulating layer 132, there is the first port 101 connected to the first transmission line 106 upon the second uppermost insulating layer by means of a conductive metal plating formed in the lead-through 110 and to the second transmission line 108 upon the lowest insulating layer 130 by means of a conductive metal plating formed in the lead-through 122.

In accordance with the presented example, the transmission lines 106, 108 lead in a planar manner from the lead-throughs 110, 112 of the first port 101 to the lead-throughs 112, 114 of the second and third ports 102, 104. However, the second port 102 and the lead-through 112 connecting the first transmission line 106 to the second port 102 are not seen in FIG. 4, because they are behind the third port 104 and the lead-through 114 connecting the second transmission line 108 to the third port 104.

Figure 5:
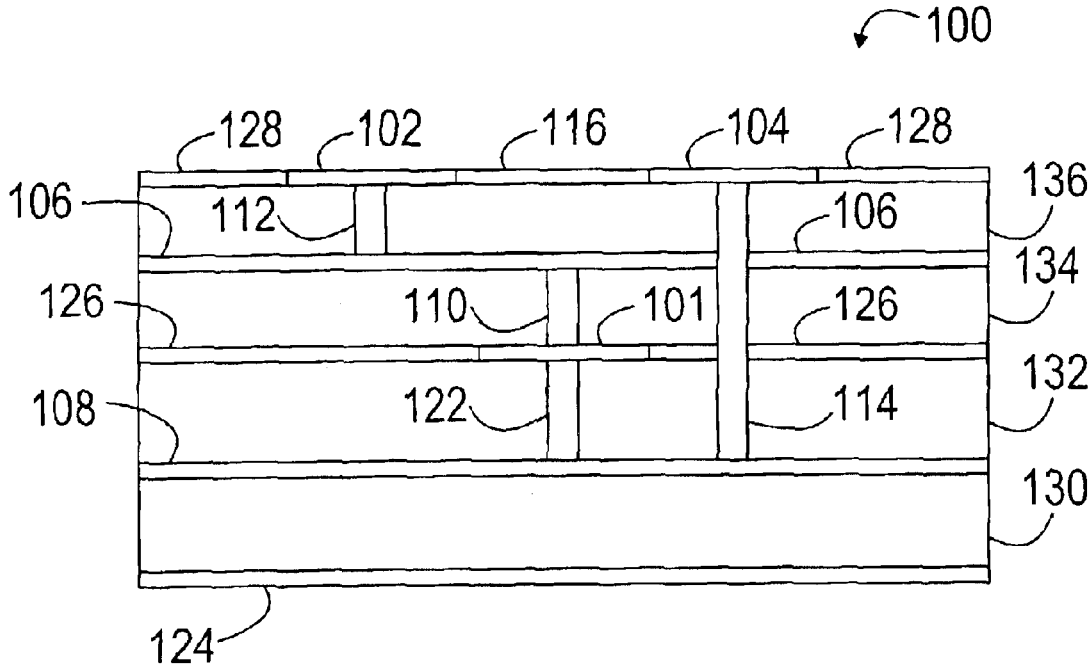
FIG. 5 shows a front view of a detail of a Wilkinson power divider according to a preferred embodiment of the invention.

FIG. 5 shows a front view of the example of FIGS. 2, 3 and 4. Those lead-throughs 120 that have conductive metal platings by means of which the connection of the conductive layers 124, 126, 128 to the transmission lines 106, 108 and the ports 101, 102, 104 is implemented are not indicated here either.

FIG. 5 shows the four insulating layers 130, 132, 134, 136 of the multilayer structure 100; the three conductive layers 124, 126, 128 functioning as reference planes; the first, the second and the third port 101, 102, 104; the first and the second transmission line 106, 108; and the lead-throughs 110, 112, 114, 122. The conductive layers 124, 126, 128 seen in FIG. 5 are below and above the insulating layers 130, 132, 134, 136 and between them. Upon the second lowest insulating layer 132, there is the first port 101 connected to the first transmission line 106 upon the third insulating layer 134 by means of a conductive metal plating formed in the lead-through 110 and to the second transmission line 108 upon the first insulating layer 130 by means of a conductive metal plating formed in the lead-through 122. On both sides of the first port 101, there is the middle conductive layer 126 functioning as a reference plane for the first and the second transmission line 106, 108 and for the second and the third port 102, 104.

The second and the third port 102, 104 are upon the uppermost insulating layer 136. The uppermost insulating layer 128, which functions as a reference plane for the first port 101 and the first transmission line 106, is upon the uppermost insulating layer 136. The conductive layer 124 positioned below the first insulating layer 130 functions as a reference plane for the second transmission line 108 and the first port 101. The first transmission line 106 is connected to the second port 102 positioned upon the uppermost insulating layer 136 by means of a conductive metal plating formed in the lead-through 112. The second transmission line 108 is, in turn, connected to the third port 104 by means of a conductive metal plating formed in the lead-through 114.

Figure 6:
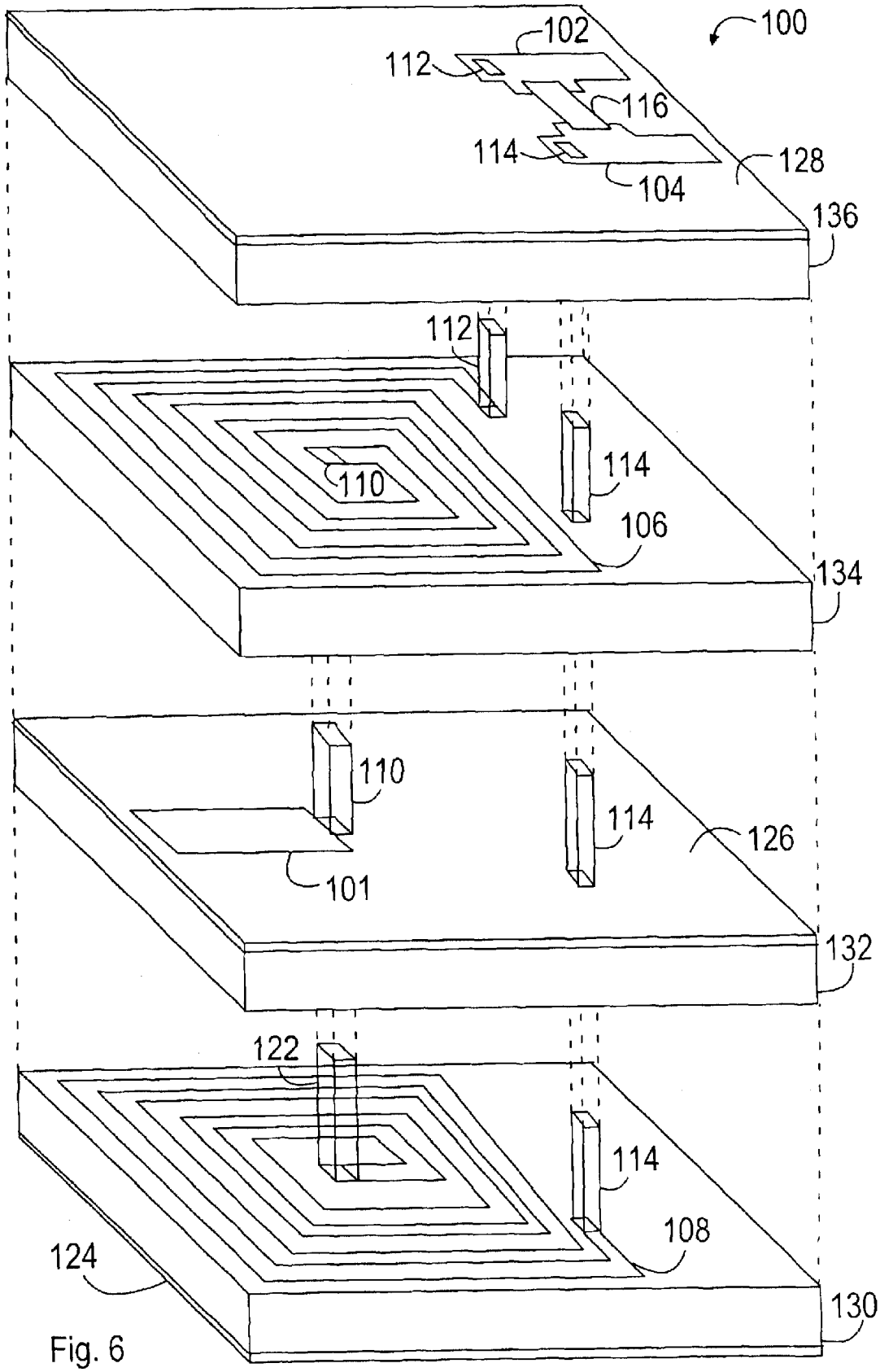
FIG. 6 shows a perspective view of a Wilkinson power divider according to a preferred embodiment of the invention.

FIG. 6 shows a perspective view of another example according to the invention. Also the Wilkinson power divider according to the example of FIG. 6, formed as a multilayer structure 100, comprises several conductive layers 124, 126, 128 functioning as reference planes; the first port 101, the second port 102 and the third port 104; the first transmission line 106 and the second transmission line 108; a passive element 116; and several lead-throughs 110, 112, 114, 122. Upon the second uppermost insulating layer 134 in the multilayer structure 100, there is the first transmission line 106. The second transmission line 108 is, in turn, upon the lowest insulating layer 130.

The conductive patterns formed by the transmission lines 106, 108 of the example of FIG. 6 are implemented in manners known per se, preferably with thin-film or thick-film techniques. Alternatively, the conductive patterns formed by the transmission lines 106, 108 can be implemented with growing or etching techniques. The transmission line 106 is connected to the first port 101 by means of a conductive metal plating formed in the lead-through 110, and the transmission line 108 is connected to the first port 101 by means of a conductive metal plating formed in the lead-through 122.

Deviating from the examples of FIGS. 2 to 5, the transmission lines 106, 108 shown in FIG. 6 are spiral-shaped. The transmission lines 106, 108 are spiral-shaped in such a way that the spiral twist in the first transmission line 106 begins to open in the opposite direction compared with the spiral twist in the second transmission line 108. In the example of FIG. 6, the spiral twist in the first transmission line 106 proceeds clockwise and is connected to the second port 102 on the left side of the port. The spiral twist in the second transmission line 108, in turn, proceeds counter-clockwise and is connected to the third port 104 on the right side of the port. In order to improve insulation, a passive element 116, for instance resistance, is mounted between the second and the third port 102, 104.

Also by means of the solution of FIG. 6, a plurality of advantages is achieved. Owing to the spiral-shaped transmission lines 106, 108 a lot of space is saved, and the conductive layers 124, 126, 128 functioning as reference planes provide good insulation between the transmission lines 106, 108 and increase the electromagnetic protection of the Wilkinson power divider towards the surroundings.

Although the invention has been described above with reference to the example of the attached drawings, it will be obvious that it is not limited to it but can be modified in a plurality of ways within the inventive idea of the attached claims.

What is claimed is:

1. A power divider/combiner comprising, formed as a multilayer structure:

several insulating layers;

several conductive layers functioning as reference planes;

a first port, a second port and a third port;

a first transmission line from the first port to the second port, a second transmission line from the first port to the third port;

conductive lead-throughs in the insulating layers and in the conductive layers for connecting the transmission lines to the ports;

at least one passive element between the second and the third ports;

the first transmission line being in an insulating layer other than the one where the second transmission line is; and at least one insulating layer is on top of each transmission line.

2. The power divider/combiner according to claim 1, wherein at least one of the conductive layers functioning as ground planes is in the area between the first and the second transmission line.

3. The power divider/combiner according to claim 1, wherein the first transmission line is in the form of successive branches, the branches comprising a diverging area and a returning area.

4. The power divider/combiner according to claim 3, wherein the diverging area of the first branch of the first transmission line and the diverging area of the first branch of the second transmission line proceed towards opposite edges of the multilayer structure.

5. The power divider/combiner according to claim 3, wherein the branches of the first and the second transmission line are parallel to each other.

6. The power divider/combiner according to claim 3, wherein the branches of the first and the second transmission lines are superposed.

7. The power divider/combiner according to claim 3, wherein the areas of the branches of the first and the second transmission line proceeding to opposite directions are superposed.

8. The power divider/combiner according to claim 1, wherein the second transmission line is in the form of successive branches, the branches comprising a diverging area and a returning area.

9. The power divider/combiner according to claim 1, wherein the first and the second transmission line are superposed.

10. The power divider/combiner according to claim 1, wherein the first transmission line is spiral-shaped.

11. The power divider/combiner according to claim 1, wherein the second transmission line is spiral-shaped.

12. The power divider/combiner according to claim 1, wherein the lead-throughs for connecting said transmission lines to the ports are impedance-matched.

13. The power divider/combiner according to claim 1, wherein the power divider/combiner is a Wilkinson power divider.

14. The power divider/combiner according to claim 1, wherein the passive element is a resistance.

15. The power divider/combiner according to claim 1, wherein the power divider/combiner is a Wilkinson power combiner.

16. The power divider/combiner according to claim 1, wherein the conductive layers functioning as reference planes are ground planes.

17. The power divider/combiner according to claim 1, wherein the transmission lines are strip lines.

18. The power divider/combiner according to claim 1, wherein the transmission lines and the conductive layers form a strip line configuration.

19. The power divider/combiner according to claim 1, wherein the first, second and third ports are strip lines.

20. The power divider/combiner according to claim 1, wherein the first and second transmission lines are of the same length.

21. The power divider/combiner according to claim 1, wherein the first and the second transmission line are of a length of $\lambda/4$.

22. The power divider/combiner according to claim 1, wherein the second port, part of the conductive layers and part of the insulating layers form a microstrip line configuration.

23. The power divider/combiner according to claim 1, wherein the third port, part of the conductive layers and part of the insulating layers form a microstrip line configuration.

24. A power divider/combiner comprising, formed as a multilayer structure:

several insulating layers;

several conductive layers functioning as reference planes;

a first port, a second port and a third port;

a first transmission line from the first port to the second port, a second transmission line form the first port to the third port;

conductive lead-throughs in the insulating layers and in the conductive layers for connecting the transmission lines to the ports;

at least one passive element between the second and the third ports;

the first transmission line being in an insulating layer other than the one where the second transmission line is; and at least one insulating layer is on top of each transmission line, wherein the third port and part of the conductive layers form a strip line configuration.

25. A power divider/combiner comprising, formed as a multilayer structure:

several insulating layers;

several conductive layers functioning as reference planes;

a first port, a second port and a third port;

a first transmission line from the first port to the second port, a second transmission line form the first port to the third port;

conductive lead-throughs in the insulating layers and in the conductive layers for connecting the transmission lines to the ports;

at least one passive element between the second and the third ports;

the first transmission line being in an insulating layer other than the one where the second transmission line is; and at least one insulating layer is on top of each transmission line, wherein the first port and part of the conductive layers form a strip line configuration.

26. A power divider/combiner comprising, formed as a multilayer structure:

several insulating layers;

several conductive layers functioning as reference planes;

a first port, a second port and a third port;

a first transmission line from the first port to the second port, a second transmission line form the first port to the third port;

conductive lead-throughs in the insulating layers and in the conductive layers for connecting the transmission lines to the ports;

at least one passive element between the second and the third ports;

the first transmission line being in an insulating layer other than the one where the second transmission line is; and at least one insulating layer is on top of each transmission line, wherein the second port and part of the conductive layers form a strip line configuration.

* * * * *